US009265317B2

(12) United States Patent
Pitchforth

(10) Patent No.: US 9,265,317 B2
(45) Date of Patent: Feb. 23, 2016

(54) SUPPORT STRUCTURE FOR LUGGAGE

(71) Applicant: Eddie Bauer LLC, Bellevue, WA (US)

(72) Inventor: Noah James Pitchforth, Issaquah, WA (US)

(73) Assignee: Eddie Bauer LLC, Bellevue, WA (US)

( * ) Notice: Subject to any disclaimer, the term of this patent is extended or adjusted under 35 U.S.C. 154(b) by 292 days.

(21) Appl. No.: 13/838,607

(22) Filed: Mar. 15, 2013

(65) Prior Publication Data

US 2013/0240314 A1 Sep. 19, 2013

Related U.S. Application Data

(60) Provisional application No. 61/612,761, filed on Mar. 19, 2012.

(51) Int. Cl.

| | |
|---|---|
| ***A45C 5/14*** | (2006.01) |
| ***A45C 7/00*** | (2006.01) |
| *A45C 5/03* | (2006.01) |

(52) U.S. Cl.

CPC ..... *A45C 5/14* (2013.01); *A45C 7/0018* (2013.01); *A45C 7/0036* (2013.01); *A45C 2005/032* (2013.01)

(58) Field of Classification Search

CPC ..... A45C 5/14; A45C 7/0036; A45C 7/0018; A45C 7/0032

See application file for complete search history.

(56) References Cited

U.S. PATENT DOCUMENTS

| | | | | |
|---|---|---|---|---|
| 6,227,339 | B1 | 5/2001 | Bogert | |
| 6,357,567 | B1 | 3/2002 | Tsai | |
| 6,443,274 | B1 * | 9/2002 | Klamm | 190/18 A |
| 6,913,386 | B2 * | 7/2005 | Maher et al. | 383/38 |
| 8,333,271 | B2 | 12/2012 | Gibson | |
| 2002/0125089 | A1 * | 9/2002 | Davis et al. | 190/107 |
| 2004/0065518 | A1 * | 4/2004 | Hoberman | 190/107 |
| 2005/0034947 | A1 * | 2/2005 | Nykoluk | 190/18 A |
| 2007/0074941 | A1 * | 4/2007 | Liang | 190/107 |
| 2011/0174583 | A1 | 7/2011 | Yoneno et al. | |
| 2013/0075214 | A1 * | 3/2013 | Chi Yueh Chen et al. | 190/18 A |

FOREIGN PATENT DOCUMENTS

| | | | |
|---|---|---|---|
| JP | 2006204736 A | * | 8/2006 |
| WO | WO 2004030488 A2 | * | 4/2004 |

OTHER PUBLICATIONS

International Preliminary Report on Patentability for International (PCT) Application No. PCT/US2013/032889, mailed Jun. 10, 2013, 6 pages.

International Search Report and Written Opinion for International (PCT) Patent Application No. PCT/US2013/032889, mailed Jun. 10, 2013 7 pages.

Official Action for Canada Patent Application No. 2,867,710, mailed Jul. 16, 2015 4 pages.

Extended Search Report for European Patent Application No. 13763650.2, dated Dec. 7, 2015 6 pages.

* cited by examiner

*Primary Examiner* — Tri Mai

(74) *Attorney, Agent, or Firm* — Sheridan Ross P.C.

(57) ABSTRACT

A luggage item is provided. The luggage item includes a support member for a rolling item of luggage, where the support member assists in enabling the luggage item to stand upright even when unattended. The support member may provide stability to the item of luggage when the item of luggage is upright, yet collapses when the luggage item is empty or at least partially unpacked.

8 Claims, 5 Drawing Sheets

SUPPORT STRUCTURE FOR LUGGAGE

REFERENCE TO RELATED APPLICATIONS

This Non-Provisional Patent Application claims the benefit of priority from U.S. Provisional Patent Application No. 61/612,761 filed Mar. 19, 2012, the entire disclosure of which is hereby incorporated by reference in its entirety.

FIELD OF THE INVENTION

The present disclosure generally relates to luggage. More specifically, the present disclosure relates to a support structure for an item of luggage such as a rolling or roller bag.

BACKGROUND OF THE INVENTION

Travelers commonly use luggage to transport personal belongings between one location and another. During transport, many travelers stand their luggage upright, on one end, at some point during their journey. For example, when at an airline ticket counter, many travelers stand their luggage upright while interacting with an airline representative. However, in many circumstances, the luggage cannot balance in this upright position without support from the traveler, and thus the luggage tips over, frustrating the traveler and possibly damaging fragile belongings contained therein.

Rolling luggage has become increasingly popular in recent years. A common configuration for this type of luggage includes a container or case portion that is generally rectangular in shape in which one or more articles can be stored for travel. The container is typically comprised of a base, side walls, ends, and a lid. A wheel assembly is commonly provided to allow the container to be rolled rather than carried. The wheel assembly generally includes a pair of wheels mounted at an interface of the base and one of the ends of the luggage. A telescoping handle assembly is generally provided attached to the base. The telescoping handle assembly has at least one, and usually two, telescoping posts that can extend from the top panel of the container, which are connected by a handle for wheeling the luggage.

Typically, such rolling luggage configurations are suitcases, which have substantially rigid sides and/or a substantially rigid lid, however suitcases can be heavy, and take up a large amount of storage space when not in use. Duffel bags are also popular because of their lightweight, flexible construction and ability to store a large quantity of items. In addition, the flexible material allows the duffel bag to be folded or crumpled for storage. However, because duffel bags are formed of flexible materials, it is generally not possible to stand them on their wheeled end unless they are very full of items because the sides and lid tend to sag under the weight of the non-wheeled end, which can tip the duffel bag over due to the weight of the telescoping handle assembly, and because the telescoping handle assembly tends to be rigid and cannot also sag uniformly with the sides and lid. Duffel bags have therefore not been successfully formed into wheeled articles of luggage.

SUMMARY OF THE INVENTION

There exists a long-felt yet unmet need to provide an item of rolling luggage comprising the structural benefits of hard case luggage while also providing the functionality or storage benefits of soft shell items. According to one embodiment of the present disclosure, a support structure for use with an item of luggage is provided. The support structure enables the item of luggage to stand on its own without assistance from a traveler. For example, the support structure may be extended or configured to enable the item of luggage to stand in an upright position without support from a traveler.

According to one embodiment of the present disclosure, a support structure is constructed of any material now known or later developed in the art. For example, the support structure may be constructed of a metallic material, a non-metallic material, or a combination thereof. In one embodiment, the support structure is constructed of aluminum. In addition, the support structure may be a bar, a plate, a rod, tubing, or other structures now known or later developed in the art. In addition, the support structure may be formed in various cross-sectional shapes including, but not limited to, c-shaped, circular, L-shaped, or square.

According to one embodiment of the present disclosure, a support structure is configured to interconnect with various types of luggage. For example, the support structure may be configured for use with any type of luggage now known or later developed in the art. In one embodiment, the support structure is configured for use with a rolling duffel bag.

In one embodiment, a collapsible article of luggage is provided, the article comprising: a substantially rigid base portion, at least one wheel assembly connected to the base portion, a retractable handle assembly connected to the base portion for towing the article of luggage on the at least one wheel assembly, a substantially flexible cover portion formed of a deformable material and secured to the base portion, the substantially flexible cover portion having a rigid reinforcement substantially contained by said flexible cover portion and being rotatable with respect to the base portion between a first position and a second position, the first position comprising an extended position adapted for providing support to the article and the second position comprising a position of non-use or storage, the rigid reinforcement interconnected to the substantially flexible cover portion at a point proximal said base portion. In certain embodiments, the rigid reinforcement is interconnected in a manner allowing for movement of an opposing end of the rigid reinforcement, the opposing end positioned generally distal from an end of the base portion from which the retractable handle is provided.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures. Those of skill in the art will recognize that the description is merely illustrative of the principles of the disclosure, which may be applied in various ways to provide many different alternative embodiments. The description is made for illustrating the general principles of the teachings of this disclosure invention and is not meant to limit the inventive concepts disclosed herein.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

Figure 1A:
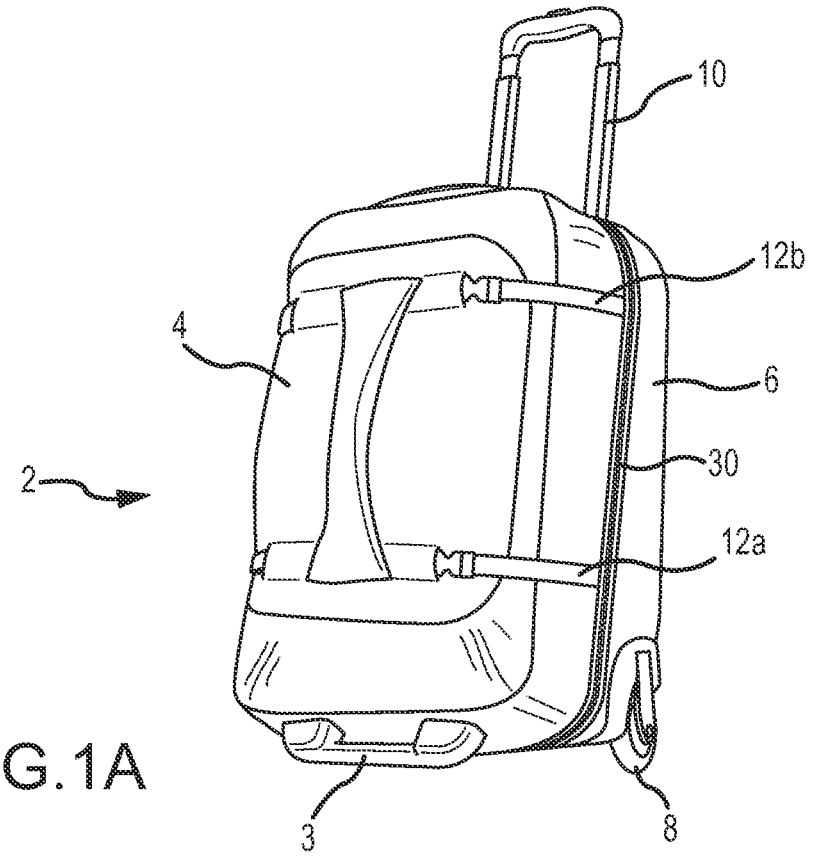
FIG. 1A is a perspective view of a luggage item according to one embodiment in a position of use.
Figure 1B:
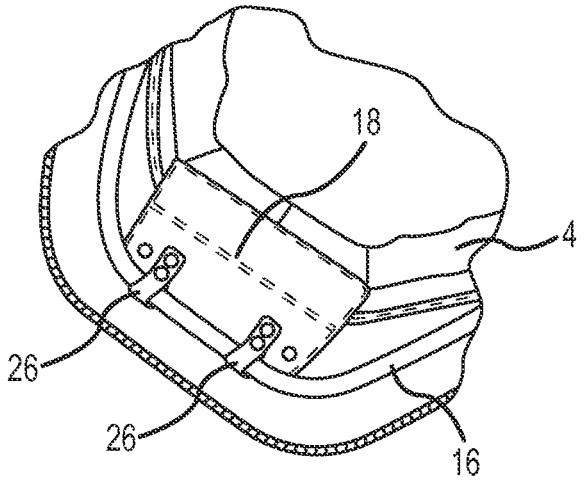
FIG. 1B is a partial exploded perspective view of a feature of a luggage item according to one embodiment.

Referring to FIGS. 1A-1B, one embodiment of a luggage item 2 is provided, the luggage item 2 comprising a support structure 16 for aiding in the use of the item 2, particularly when the item 2 is to be stood upright. As shown, the luggage item 2 comprises a substantially soft or flexible cover portion 4 which is comprised of, for example, nylon or similar material. A rigid portion 6 is further provided, such that at least a portion of the item 2 comprises a hard-shell or rigid surface. Preferably, at least two wheels 8 are provided at bottom corner portions of the device 2, such that the device 2 is adapted to be rolled or wheeled by user-contact with a handle portion 10. The handle portion 10 preferably comprises a telescoping or retractable handle that may be selectively deployed and stored. Such devices include, but are not limited to, those described in U.S. Pat. No. 8,333,271 to Gibson, which is hereby incorporated by reference in its entirety. In alternative embodiments, the bag 2 is devoid of telescoping handles. Alternatively, and by way of example only, the bag may comprise one or more straps suitable for towing or pulling the bag 2.

A plurality of straps may be provided. For example, the depicted embodiment comprises at least one compression strap 12*a*, 12*b* for securing or compressed the volume of the item 2, and hand or shoulder strap(s) for manipulation of the item. The flexible cover portion 4 is interconnectable to the base portion 6 via a zipper 30 and/or various additional fasteners. It will be recognized, however, that the present invention is not limited to any particular number or arrangement of such straps or grasping features. Additionally, a foot or stand member 3 is provided at a lower portion of the bag in at least some embodiments. The foot 3 provides for a rigid or semi-rigid member to aid in support the bag in an upright position, as well as reducing the risk of damage to a soft cover portion 4 of the item 2.

FIG. 1B depicts a cut-away view of a portion of the item 2, illustrating various internal components of the present disclosure. As shown, an interior portion of the flexible portion 4 of the item 2 comprises a reinforcing member or support structure 16. In certain embodiments, the support structure 16 comprises a substantially rigid member extending around or toward at least a bottom or lower portion of the bag 2. In one particular embodiment, the support structure 16 comprises a rod member, such as an aluminum rod, at least partially enclosed within portion(s) of the item 2. The rod is contemplated as comprising a generally U-shaped feature adapted to swing or rotate outwardly and provide structural support to an otherwise soft portion of the luggage item 2. Alternatively, support members 16 comprise L-shaped features, parallel straight line features, and various similar shaped structures suitable for providing support to the item 2.

As further shown in FIG. 1B, the support member 16 is at least partially to secured to a portion of the luggage item 2, such as the rigid portion 6, via collapsible member 18. Collapsible member 18, as shown and described in more detail herein, generally comprises a lightweight collapsible feature for defining a limit of outward rotation of the support 16. The collapsible member 18 may be secured to the support member 16 via loops and/or rivets 26 as shown in FIG. 1B, or various similar structures and securing means as will be recognized by one of ordinary skill in the art.

The support structure 16 illustrated in FIGS. 1A-1B is generally associated with the wheel end of the rolling duffel bag 2. In one embodiment, the support structure is positioned internal to the rolling duffel bag and may be associated with the side and bottom surfaces of the rolling duffel bag.

In various embodiments, the support structure 16 comprises a collapsible feature. In one configuration, the support structure 16 includes a collapsed position and a non-collapsed position. The collapsed position of the support structure may correspond to situations in which an expandable portion of the bag is not expanded, such as when the bag 2 is underpacked or empty. In one embodiment, the support structure 16 is biased toward a collapsed position. For example, a spring may be interconnected to a second segment of the support structure 16 and configured to bias the support structure 16 toward the collapsed position. The non-collapsed position of the support structure 16 may correspond to situations in which an expandable portion 4 of the bag 2 is expanded, such as when the bag 2 is fully packed. In the non-collapsed position, the support structure 16 provides stability to the bag 2 in an upright position and enables the bag 2 to stand in an upright position without support from a user. As illustrated in FIG. 1, in one embodiment the support structure may act like a kickstand to prevent the bag from tipping over when in an upright position.

Figure 2:
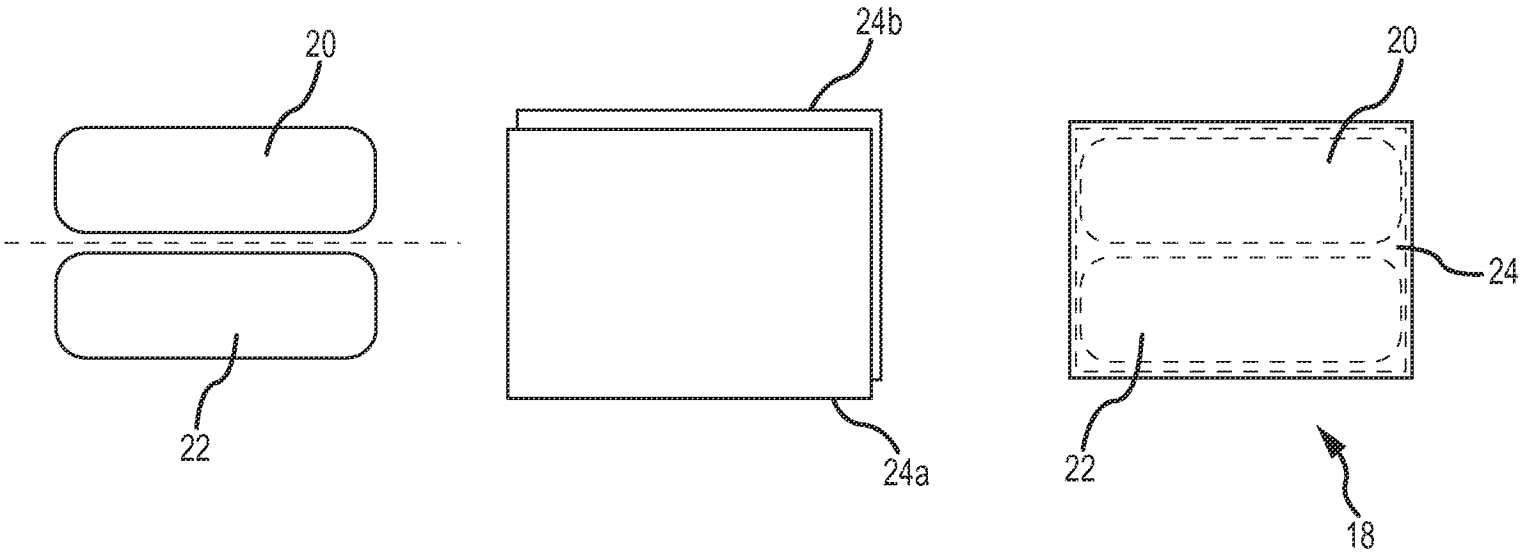
FIG. 2 depicts various components of one embodiment of the present invention in plan view.

FIG. 2 depicts the collapsible member 18 and components thereof in various phases of construction. As shown, a collapsible member 18 may be formed by providing two polyethylene members 20, 22 of substantially similar size, providing layers of fabric or lining 24*a*, 24*b*, and securing the members 20, 22 within the layers of lining 24*a*, 24*b*.

Although FIG. 2 depicts one embodiment of a collapsible member 18 for use with a luggage item, it will be recognized that various alternative embodiments are contemplated. A plurality of devices for restraining or guiding the support member 18 within the contents or sidewalls of a bag is contemplated, and the present invention is not limited to any particular arrangement. For example, the support member 16 may be tethered to additional portions of the luggage item by one or more straps, the one or more straps having a predetermined length such as to limit the rotation or extension of the support member 16. In addition to or in lieu of such features, the extension or maximum rotation of the support 16 may be limited by the non-rigid portion 4 of the bag 2. For example, in various embodiments, the position of the support member is provided substantially adjacent an outer seam of the soft portion 4 of the bag 2, and generally contained within the soft portion 4, such that the soft portion 4 contains or restrains movement of the support past a certain position.

Figure 3:
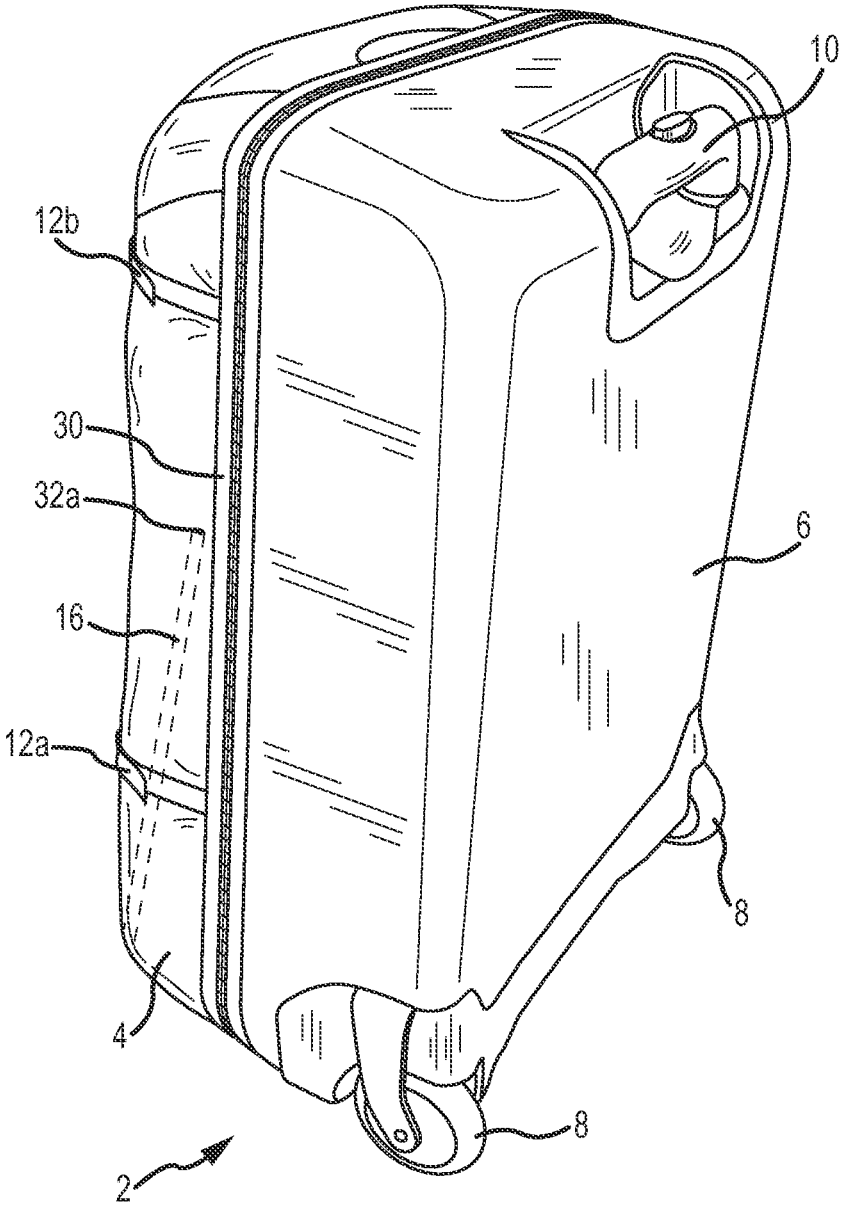
FIG. 3 is a rear perspective view of one embodiment of the present invention.

Referring now to FIG. 3, an embodiment of the luggage item 2 is depicted in a upright position. As shown, the item 2 comprises a substantially rigid portion 6, a soft shell portion 4, one or more straps 12*a*, 12*b*, and a telescoping handle portion 10.

FIG. 3 depicts the bag 2 in an upright position and one in which known rolling bags are prone to fall, particularly when left unattended. Devices and features of the present disclosure, including extended support structure 16 provide structure to the otherwise flexible cover portion 4 and enable the bag 2 to stand upright under the force of gravity. Internal components such as connection means 32*a* and support member 16 are shown in phantom in FIG. 3, as such features would be concealed within the confines of the item 2 as shown and described herein. In the packed state of FIG. 3, the support 16 is prevented from collapsing due the packed nature of the bag and connection means 18, 26 joining the support 16 to the cover portion 4.

Figure 4:
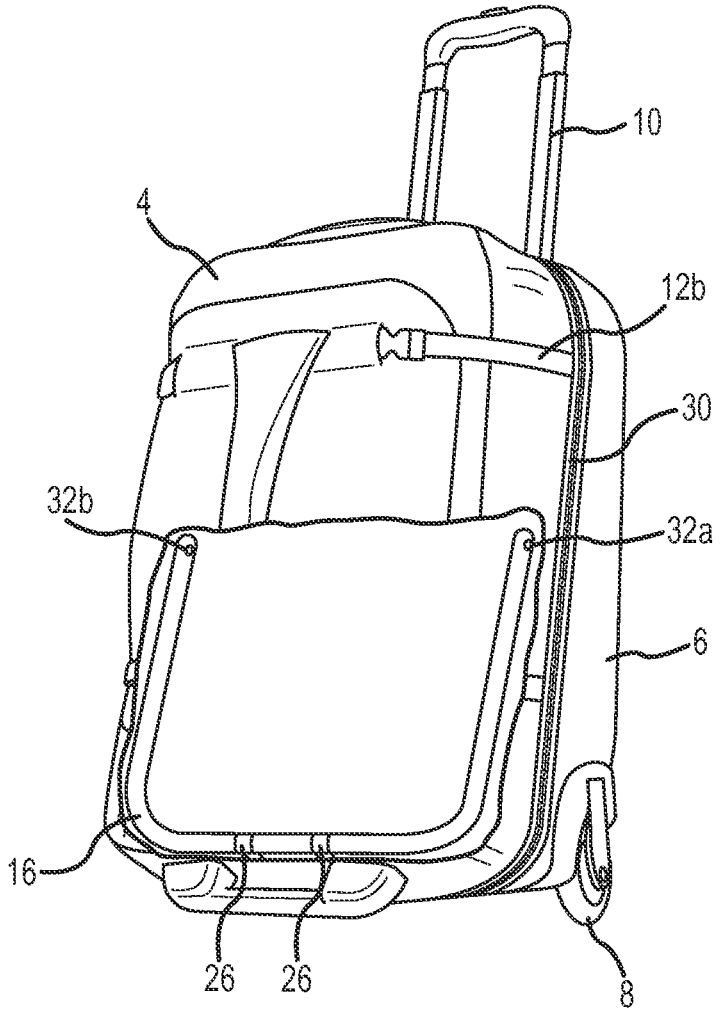
FIG. 4 is a partial cut-away perspective view of one embodiment of the present invention.

FIG. 4 is a partial cut-away perspective view of one embodiment of the luggage item 2, and showing the support structure 16 in a deployed position. As shown, the support structure 16 is pivotally connected to the bag 2 in at least one location 32*a*, 32*b*, the at least one location being proximal to a height-wise midpoint of the luggage item 2. Thus, a lower portion of the support structure 16 is capable of swinging or rotating outwardly when the bag is fully packed, for example, thereby providing a substantially rigid support member and structure to the bag. In various embodiments, the support structure 16 is interconnected at pivot points 32*a*, 32*b* to one or more portions of the item 2 by various fasteners, including, for example, Hypalon® fabric or chlorosulfonated polyethylene synthetic rubber connectors for joining the ends of the support 16 to a portion of the bag. Although various features and devices for this connection are contemplated, certain embodiments comprise hypalon to provide a rigid connection and reduce the risk of ends 32*a*, 32*b* damaging the bag or zipper. Hypalon flaps, sleeves, pouches, or connection means are stitched, for example, to the bag 2 at a point proximal the zipper 30 (such as the zipper seam) such that free ends 32*a*, 32*b* of the support 16 comprise rotation points that will not translate away from the zipper 30. In certain embodiments, the support 16 comprises an angle proximal to an entrance point with the connection means, such that it exits the connections at a slightly different angle from that in which it is positioned within the connections means.

In addition to or in lieu of the hypalon flap features, connection means for free ends 32*a*, 32*b* comprise various connections. For example, it is contemplated that pin connections may be provided wherein a rivet or similar feature secured to the cover portion 4 of the bag 2 and associated pin member extend through the free end 32*a*, 32*b* of the support 16 and thereby allow for rotation of the support at least between a position of use and a position of non-use.

Figure 5:
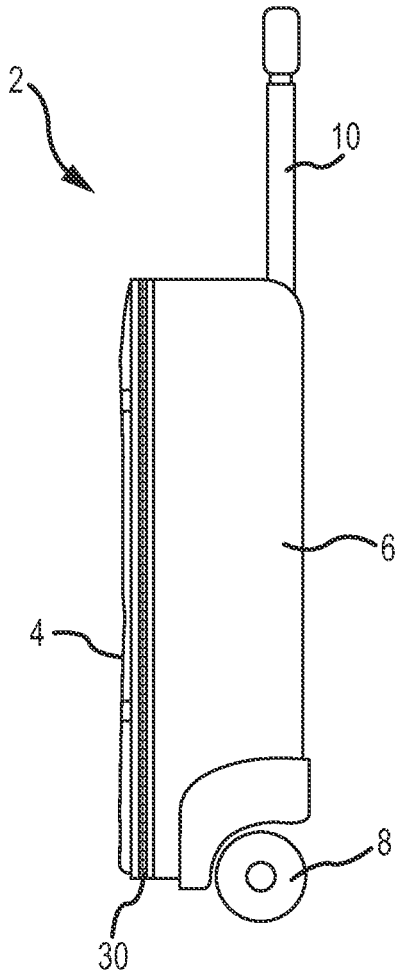
FIG. 5 is a perspective view of one embodiment of the present invention in a position of non-use.

FIG. 5 is a side elevation view of one embodiment of a luggage item 2 in an unpacked or partially unpacked state. As shown, the substantially soft portion 4 is collapsible. The support structure 16 and corresponding soft portion 4 are thus adapted to be collapsed or compressed. As shown, the soft portion 4 and support structure 16 are collapsed within the substantially rigid structure 6 and thus provide for ease of storage and/or transport when the item 2 is unpacked. Accordingly, the present invention provides a novel luggage item comprising at least one substantially rigid support structure, the support structure being deployable, rotatable, and/or extendable when the item is in a packed or at least partially packed state, yet allows the support structure to collapse or be compressed, thus facilitating storage.

While various embodiments of the present invention have been described in detail, it is apparent that modifications and alterations of those embodiments will occur to those skilled in the art. It is to be expressly understood that such modifications and alterations are within the scope and spirit of the present disclosure. Further, it is to be understood that the phraseology and terminology used herein is for the purposes of description and should not be regarded as limiting. The use of "including," "comprising," or "having" and variations thereof herein are meant to encompass the items listed thereafter and equivalents thereof, as well as, additional items.

What is claimed is:

1. A collapsible article of luggage comprising:

a substantially rigid base portion comprising a retractable handle assembly and at least one wheel assembly, the substantially rigid base portion comprising a first panel and a plurality of substantially rigid panels extending substantially perpendicular thereto;

a substantially flexible cover portion formed of a deformable material and secured to said base portion, and wherein the substantially flexible cover portion comprises an expandable portion at least with respect to the base portion;

a generally U-shaped rigid reinforcement member substantially contained within the substantially flexible cover portion, the reinforcement member being rotatable with respect to said base portion between a first position and a second position, said first position comprising an extended position adapted for providing support to the article and said second position comprising a position of non-use or storage;

a first end of said rigid reinforcement interconnected to said substantially flexible cover portion at a point proximal to a mid-point of said base portion, wherein said rigid reinforcement is interconnected in a manner allowing for movement of a second end of said rigid reinforcement, said second end positioned generally distal from an end of the base portion from which said retractable handle is provided; and wherein said second end of said rigid reinforcement member is interconnected to said base portion by a collapsible member having a predetermined length and provided to define a limit of rotation of the rigid reinforcement, said collapsible member comprising two or more panel members foldable with respect to one another.

2. The collapsible article of luggage of claim 1, wherein at least a portion of said substantially flexible cover portion is selectively connectable to said base portion by a zipper.

3. The collapsible article of luggage of claim 1, wherein said rigid reinforcement comprises a wireframe member in communication with said substantially flexible cover portion and extending around approximately one-half the perimeter of the substantially flexible portion.

4. The collapsible article of luggage of claim 1, wherein the rigid reinforcement comprises first and second longitudinally extending support members and a lateral support member interconnected to least one of said first and second longitudinally extending support members.

5. A collapsible article of luggage comprising:

a base portion comprising a first panel and a plurality of substantially rigid panels extending substantially perpendicular thereto, the panels at least partially defining a storage volume, and a retractable handle assembly on a first end of the base portion and at least one wheel on a second end of the base portion;

a cover portion connected to said base portion and having a hinge portion to facilitate moving the cover portion at least between open and closed positions;

the cover portion comprising a deformable portion and further defining the storage volume, the deformable portion being collapsible from a first position to a second position, the second position comprising a stowed position wherein the cover portion is collapsed toward said base;

the cover portion comprising a wireframe reinforcing member within said cover portion and wherein a first end of the wireframe reinforcing member extends from a location proximal a height-wise midpoint of the article;

the wireframe reinforcing member rotatable about said location and between a first position of use and a second position of storage;

a second end of the wireframe reinforcing member moveable with respect to the base portion and interconnected to the base portion by a collapsible member having a predetermined length and provided to define a limit of rotation of the wireframe reinforcing member, the collapsible member comprising two or more panel members foldable with respect to one another;

wherein the rigid reinforcing member prevents at least a portion of the cover portion from sagging when said article is stood on end.

6. The collapsible article of luggage of claim 5, wherein at least a portion of said cover portion is selectively connectable to said base portion by a zipper.

7. The collapsible article of luggage of claim 5, wherein the wireframe reinforcing member comprises a generally U-shaped member.

8. The collapsible article of luggage of claim 5, wherein the wireframe reinforcing member comprises first and second longitudinally extending support members and a lateral support member interconnected to least one of said first and second longitudinally extending support members.

* * * * *